US006361430B2

(12) United States Patent
Kitching et al.

(10) Patent No.: US 6,361,430 B2
(45) Date of Patent: Mar. 26, 2002

(54) BALANCED VENTILATION DOORS

(76) Inventors: Wayne William Kitching, 3300 Regional Road 15; Marcel Charles Lefebvre, 3280 Regional Road 15, both of Chelmsford (CA), P0M 1L0

( * ) Notice: Subject to any disclaimer, the term of this patent is extended or adjusted under 35 U.S.C. 154(b) by 0 days.

(21) Appl. No.: 09/785,187

(22) Filed: Feb. 20, 2001

Related U.S. Application Data

(63) Continuation-in-part of application No. 09/472,141, filed on Dec. 23, 1999, now abandoned.

(30) Foreign Application Priority Data

Jan. 15, 1999 (CA) ..... 2259348

(51) Int. Cl.[7] ..... E21F 1/10
(52) U.S. Cl. ..... 454/169; 49/21; 49/114; 49/366
(58) Field of Search ..... 454/168, 169; 49/21, 114, 116, 118, 122, 366; 299/12; 405/132

(56) References Cited

U.S. PATENT DOCUMENTS

| | | | | | |
|---|---|---|---|---|---|
| 1,432,972 | A | * | 10/1922 | Dealy | 454/169 X |
| 3,407,534 | A | * | 10/1968 | Bird | |
| RE34,053 | E | * | 9/1992 | Kennedy et al. | 405/132 |
| 5,240,349 | A | * | 8/1993 | Kennedy et al. | 405/132 |
| 5,900,815 | A | * | 5/1999 | Story | 49/13 X |

FOREIGN PATENT DOCUMENTS

| | | | | |
|---|---|---|---|---|
| GB | 1153336 A | * | 8/1963 | 454/169 |

* cited by examiner

*Primary Examiner*—Harold Joyce
(74) *Attorney, Agent, or Firm*—Anthony Asquith & Co.

(57) ABSTRACT

A pair of door-sections make up a mine ventilation door. The door-sections are hinged to the side-walls of the passage. One of the door-sections opens upstream and the other downstream, so one is blown open, and the other blown closed, by winds passing through the passage. A linkage couples the door-sections, and harnesses the blow-open force and balances it against the blow-closed force, whereby only a small actuation force is needed to open and close the doors. The linkage ensures that the arcuate travels of the two door-sections are equal, or otherwise correspond.

18 Claims, 4 Drawing Sheets

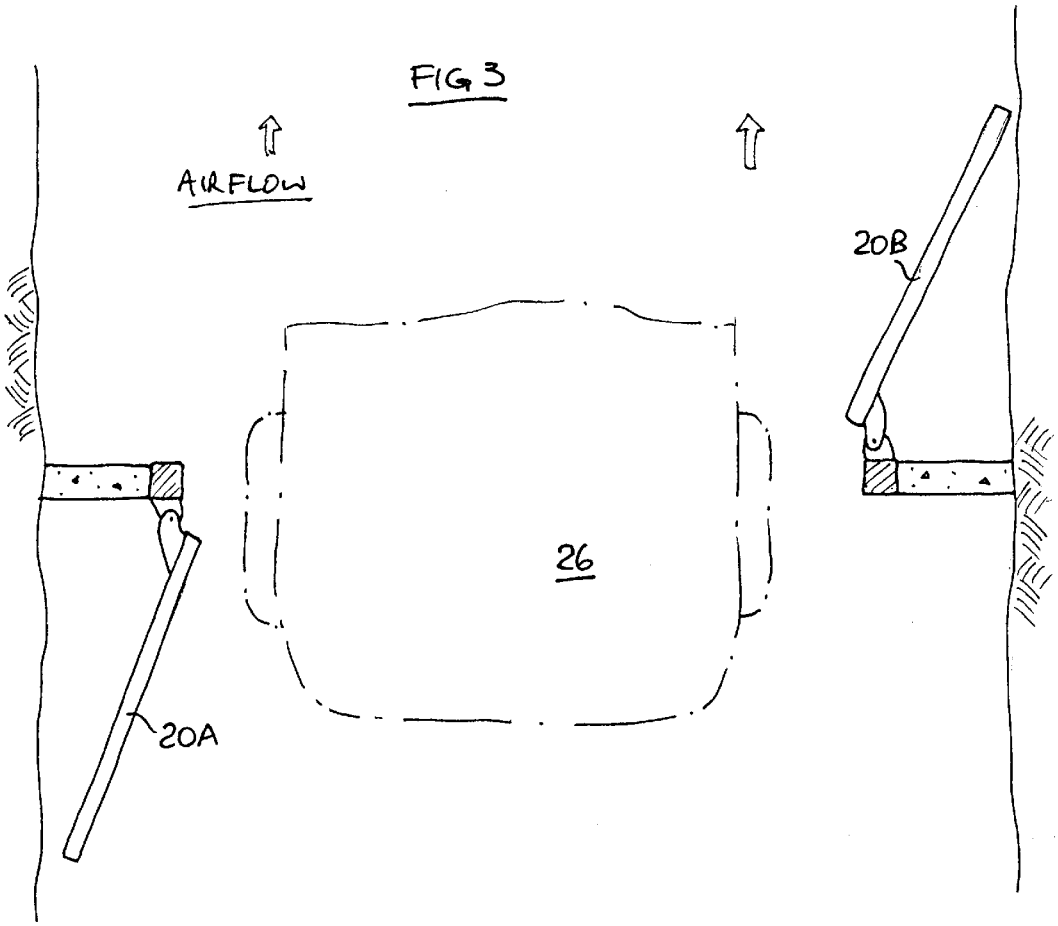
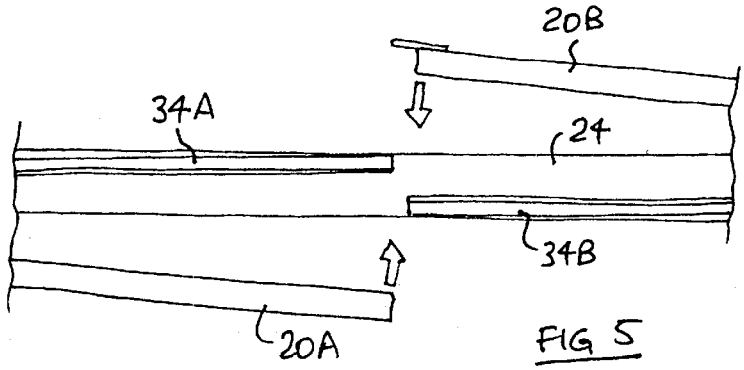
FIG 5

BALANCED VENTILATION DOORS

This is a Continuation-in-Part of patent application Ser. No. 09/472,141, filed Dec. 23, 1999, now abandoned.

This invention relates to doors, of the kind as used in underground tunnels and passageways for the control of ventilation.

Traditionally, the door apparatus is provided as a pair of door-sections, which are hinged one to the left side-wall and the other to the right side-wall of the passage. The door-sections operate like canal-lock gates, i.e the door-sections extend each halfway across the passage to close off the passage to airflow, and the door-sections open both together, to lie flat against the sidewalls of the tunnel, to allow traffic to pass through.

When the doors are being opened or closed, the traditional design requires the door-sections to open either both against, or both with, the flow of air passing through the passage. Mine ventilation doors can be large, for example each door-section may be three meters high and three meters wide. Even a small pressure difference across the doors creates an enormous force tending to blow the doors open, or closed, and the door actuation system must provide enough force to overcome the pressure differential.

Providing a means, down a mine, for exerting such large forces is not only inconvenient, but can lead to safety problems. It is not unusual for mine-workers to be injured by ventilation doors. In order to close the doors against the air pressure, the actuators have to be so powerful they cannot even detect the presence of the worker. Precautions must be taken to prevent the door-sections being blown open or closed, in case the power supply to the actuator should fail.

One proposal has been to provide two pairs of door-sections, arranged in an air-lock configuration. The force needed to open or close one pair of door-sections of course is much less if the passage is already closed by the other pair of door-sections. However, the ventilation fans are usually not switched off simply to enable the passage is to be changed from being open for ventilation to being closed (or vice versa); since the ventilation status of the passage still has to be changed while the fans are on, one of the door-section pairs has to open or close against the full airflow. Arranging mine doors in an air-lock configuration, besides doubling the cost, in fact does not allow the designer to provide a less powerful actuation system.

GENERAL FEATURES OF THE INVENTION

The invention provides a door apparatus in which the door-sections open, not in the manner of lock-gates, but in the manner whereby one door-section opens upstream while the other door-section opens downstream. Thus, one door-section opens against, while the other opens with, the air pressure. Thus, one door-section is being urged to blow open, while the other door-section is being urged to blow closed.

In the invention, the door apparatus includes a mechanical linkage, which couples and connects the door-sections, and transfers forces between the door-sections. Theoretically, the door-sections can be exactly balanced: i.e the force tending to blow the upstream door-section closed is exactly balanced by the force tending to blow the downstream door-section open. That being so, the force required to actuate the door apparatus from the open condition to the closed condition (and vice versa) is minimal. Because the force required from the actuator is so small, the power of the actuator now can be light enough not to cause injury to a worker who might have fallen between the door-sections.

The actuation force is, at least theoretically, independent of the magnitude of the air pressure differential acting on the door. In practice, a large pressure differential puts larger forces onto the door hinges and the linkage, and the increased friction would be reflected in an increase in the force needed to open and close the door.

Since the actuator only need provide a small force, the actuator can be a wholly electrical unit. This is preferred because, increasingly, below-ground operations must have the ability to be powered and controlled remotely from the surface, and electrical devices are much more convenient than pneumatic or hydraulic force-actuators in this regard. With traditional pneumatically-operated doors, often the door-actuators are the only below-ground machines that require compressed-air lines to be run down from the surface. Also, an all-electric actuator can be powered by stand-by batteries in emergencies.

For vehicular traffic, the actuator should be provided with a signal sensor, enabling the driver to remain with the vehicle while operating the doors. But, as mentioned, by the use of the invention, the door-sections can be balanced sufficiently that the worker can pull the door-sections open by hand, walk through the gap, then close the door-sections, again by hand. The worker might be discomforted by the wind draft that then blows through the gap, but at least the worker can, if required, control the opening and closing of the doors by hand action, even in the event of power failure. Preferably, the actuator should be of the type that permits the door-sections to be moved when the actuator is not being supplied with power, whereby the worker does not have to dismantle the actuator in order to open and close the doors by hand.

With the invention, there is no need for the traditional small man-door to be let into the ventilation-door. Indeed, traditional man-doors have been subject to slamming or blowing open, violently enough to cause injury to an unwary worker. However, a man-door may be provided, if desired. In fact, one field for applying the invention is to replace the (dangerous) man-doors in existing traditional ventilation-doors by a pair of half-doors which are operated in the force-balanced, one-upstream-one-downstream, manner of the invention.

The invention provides a manner of operating mine ventilation-doors which, though safer and more convenient, can be significantly less expensive than traditional systems. As will be described, the linkage connecting the door-sections can be cheap to manufacture, and need not require sophisticated set-up and adjustment.

DETAILED DESCRIPTION OF PREFERRED EMBODIMENTS

By way of further explanation of the invention, exemplary embodiments of the invention will now be described with reference to the accompanying drawings, in which:

FIG. 3 is the same view as FIG. 2, but shows the doors in a wide-open position.

FIG. 5 is a plan view from underneath the door apparatus of FIG. 1, and shows a door-lintel of the apparatus.

The apparatuses shown in the accompanying drawings and described below are examples which embody the invention. It should be noted that the scope of the invention is defined by the accompanying claims, and not necessarily by specific features of exemplary embodiments.

Figure 1:
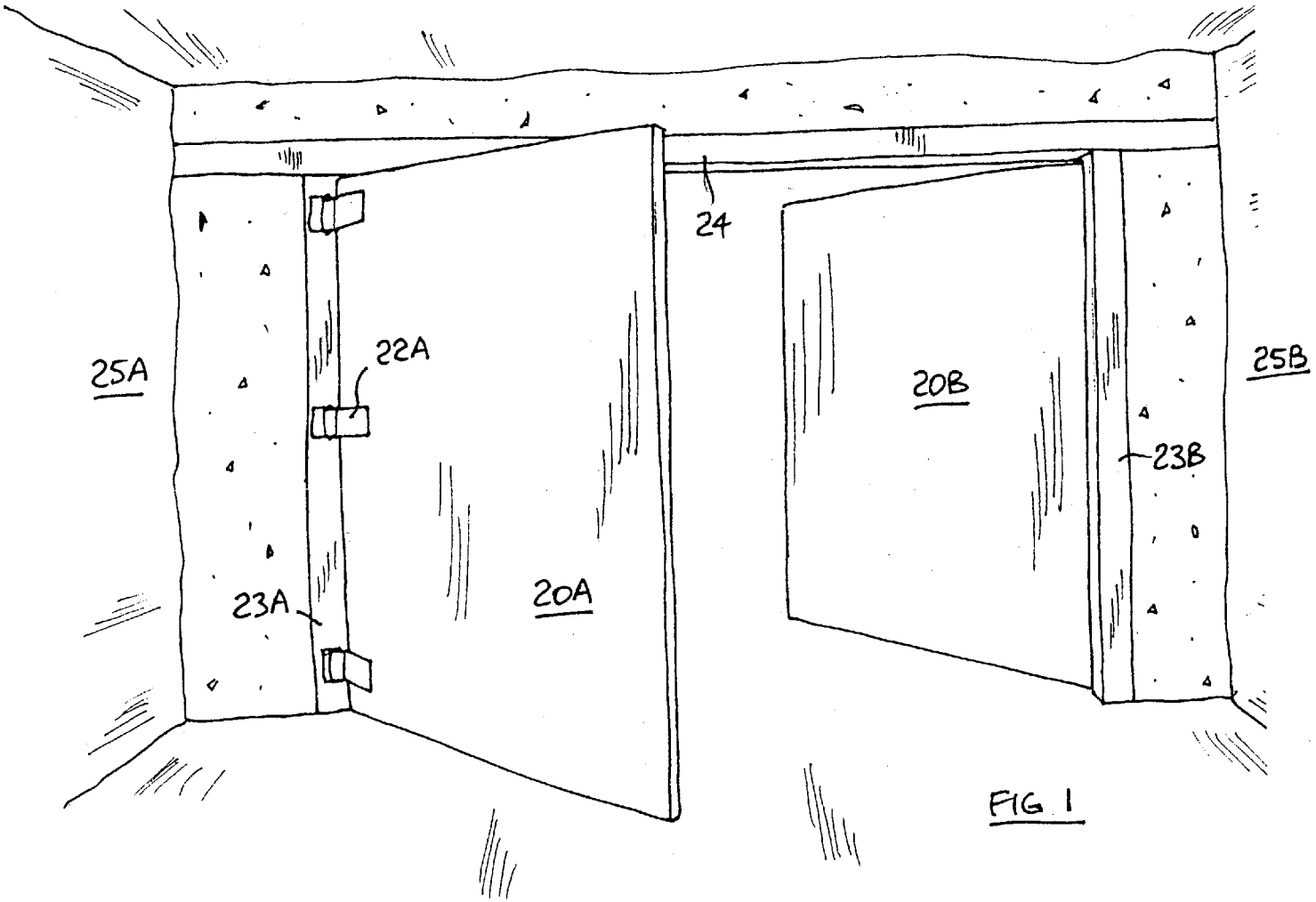
FIG. 1 is a pictorial view of a mine tunnel, having a ventilation door apparatus that embodies the invention.
Figure 2:
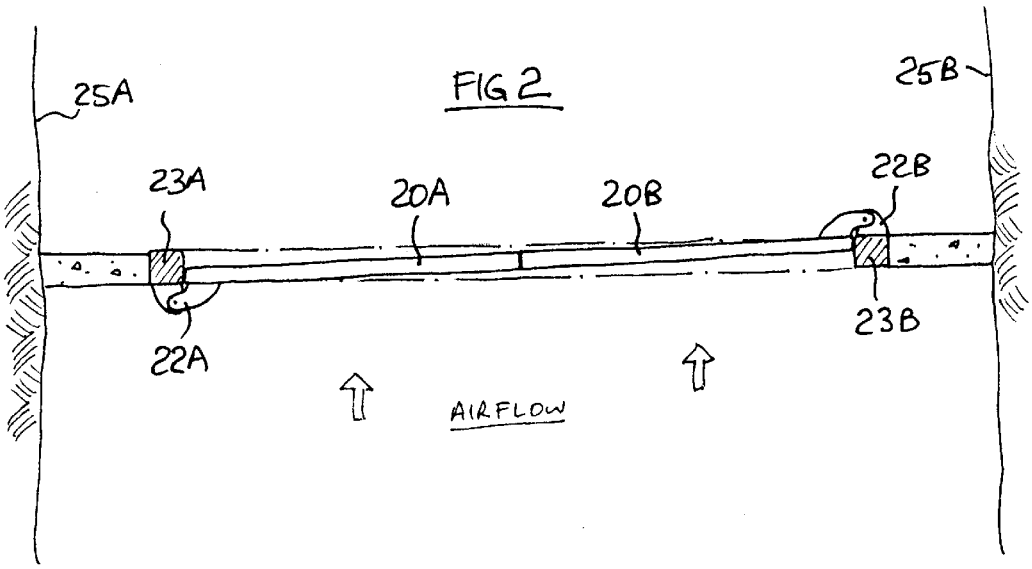
FIG. 2 is a diagrammatic plan view of the door apparatus of FIG. 1, showing the doors in a closed position.

The manner in which the doors open and close is shown in FIGS. 1–3. Door-section 20A opens towards the upstream side and door-section 20B opens towards the downstream side. The door-sections are hinged, at 22A,22B, to jambs 23A,23B of the door frame. The jambs 23A,23B and lintel 24 of the door frame are concreted into the sidewalls 25A,25B and roof of the passage.

When the doors are open, there is a clear passage between the door-sections for a vehicle 26 to pass through. It may be noted that, generally, tunnels in mines are only one vehicle-lane wide, so the door-sections have to open in such a manner as to provide a clear space between the door-sections. If the door-sections were hinged, not to the side-walls of the tunnel, but to a central post, for example, one of the door-sections, by itself, would have to open wide enough for the vehicle to pass through. This would be quite inappropriate in most mine situations.

Figure 4:
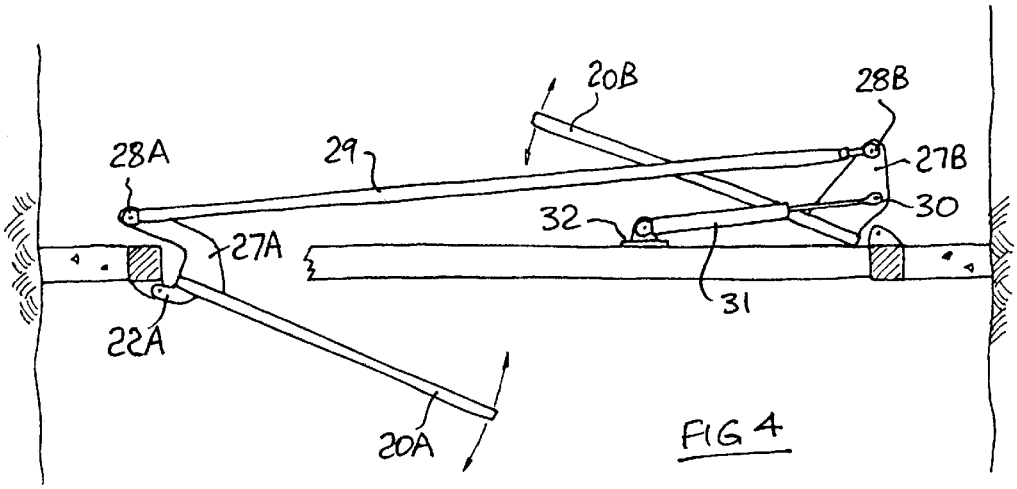
FIG. 4 is a diagrammatic plan view of the door apparatus of FIG. 2, which shows a mechanical linkage and actuation system of the apparatus, and shows the doors in a partially-open condition.

FIG. 4 shows the mechanical linkage that ensures the door-closing force on door-section 20A is transmitted to door-section 20B, and the door-opening force on door-section 20B is transmitted to door-section 20A. The linkage constrains the door-sections to move in corresponding (preferably equal) arcs. The door-sections have respective lever-arms 27A,27B, which are fixedly integrated into the body of the respective door-sections. Both lever-arms extend towards the upstream side, so the lever-arms are of different shape, as shown, to accommodate the hinging motion around the jambs 23A,23B.

The lever-arms 27A,27B carry respective arm/link-attachment-points 28A,28B. A connecting-link 29 is mounted between these points. The linkage, including the connecting-link 29 coupled between the two lever-arms 27A,27B, constrains both door-sections to rotate in the same sense, i.e both clockwise or both anticlockwise. Lines joining the pivot axes of the respective hinges 22A,22B to the respective arm/link-attachment-points 28A,28B preferably are equal in length, and parallel, but other geometries may be used. Often, the door-sections are required to open a few degrees more than ninety degrees. The designer must see to it that the linkage can accommodate the full arcs of movement of the door-sections.

The connecting-link 29 is of such a structure that it can be adjusted in length (e.g by the use of left- and right-hand threads at its ends), whereby the linkage installation can be accurately matched to the particular door.

One of the lever-arms 27B has an actuator-connection-point 30, and an actuator 31 is mounted between the point 30 and a mounting bracket 32 which is fixed to the lintel 24 of the door frame. The actuator 30 is of the recirculating-ball screw-jack type, and the actuator is operated by an electric motor. Such actuators are economically obtainable at force-ratings up to a few hundred pounds, which is all that is required of the actuator for a door-operating mechanism of the invention, when properly designed.

Preferably, the cut-out that is provided on such actuators may be set at about seventy pounds, on the basis, the designer may note, that, if the actuation force rises above that level, probably something is interfering with the movement of the doors, and movement of the doors should cease, to avoid injury or damage to personnel or equipment.

In the invention, the actuator 31 supplies only the difference in force between the upstream door-section 20A and the downstream door-section 20B, and is not sensitive to the actual magnitude of the forces on the door-sections, since those forces cancel each other out. In a well-engineered system, the difference between the force on door-section-A and the force on door-section-B comes from such comparatively minor sources as friction in the hinges and pivots of the linkage. On the other hand, especially when the doors are almost closed, i.e when air rushes through the (narrow) gap at high speed, it can happen that the swirling air currents can lead to vigorous aerodynamic effects which cause the door-sections to experience differences of wind force, and the actuator should be rated to accommodate this.

Sometimes, the designer may prefer to build in (slight) differences between the door-sections—to bias the doors closed, for example. However, preferably, and especially in cases where the ventilation air can blow either way along the passage, the door-sections and the linkage should be designed to be symmetrical, i.e balanced, as to the air-pressure forces acting on the door-sections.

Door-stops 34A,34B are provided underneath the lintel 24 of the door-frame, as shown in FIG. 5. The door-stops comprise angle-strips, welded to the lintel, which the tops of the door-sections can abut against when fully closed. The door-sections are not sealed, so when the doors are closed wind can still leak through around the edges, so the designer should arrange the manner in which the door-sections actually close together to minimize direct drafts.

Figure 6:
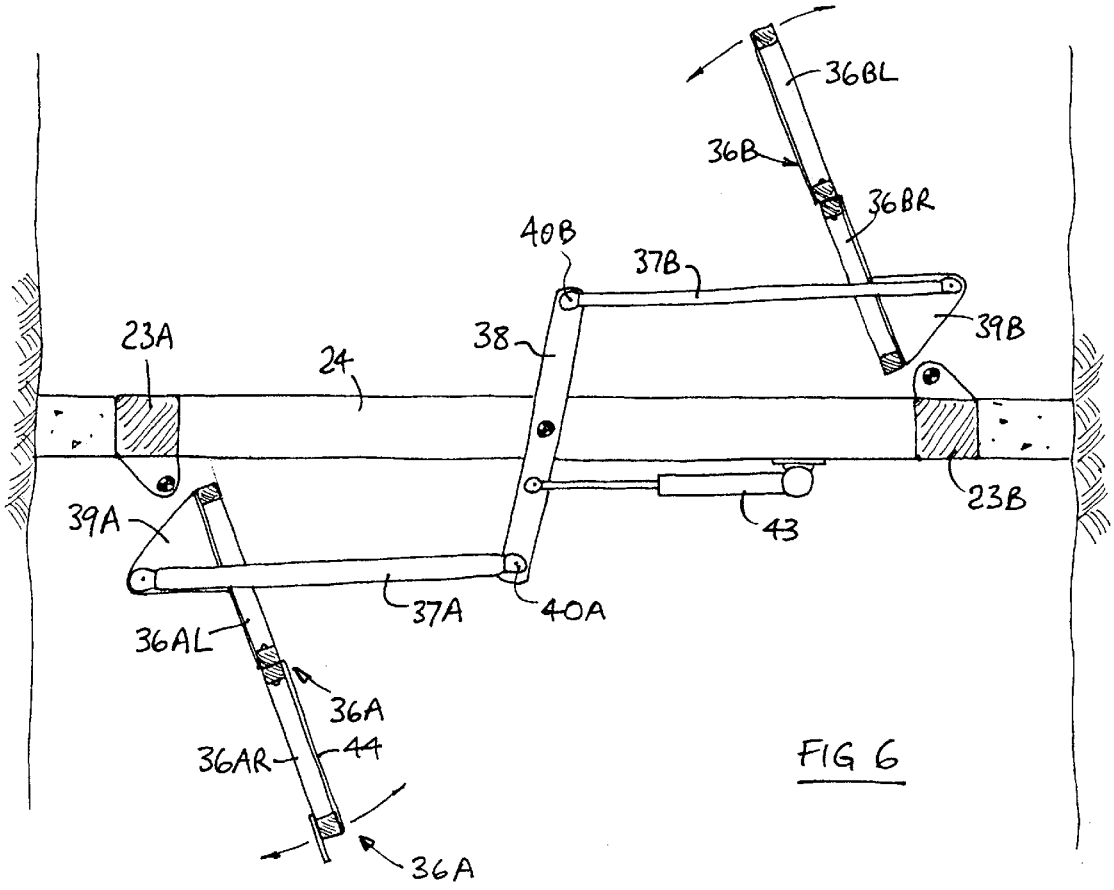
FIG. 6 is a diagrammatic plan view corresponding to FIG. 4 of another door apparatus that embodies the invention, and shows the doors in a partially-open condition.

FIG. 6 shows another type of mechanical linkage, which is effective to utilise the blow-open force on the downstream door-section to balance and cancel out the blow-closed force on the upstream door-section.

In FIG. 6, the door-sections 36A,36B are identical, the two connecting-links 37A,37B are identical, and the actuation-bar 38 is symmetrical. This simplifies installation and assembly. Lever-arms 39A,39B are attached to the respective door-sections. Connecting-links 37A,37B connect the lever-arms to bar/link-attachment-point-A 40A and bar/link-attachment-point-B 40B on the central actuating-bar 38. The actuating-bar 38 is pivoted to the underside of the lintel 24. The recirculating-ball screw-jack 43 actuator acts between the actuating-bar 38 and the doorframe.

The arrangement as shown in FIG. 6 makes it easy for the designer to ensure that the pivoting components remain always in geometrically-favourable sectors of their arcuate movements. It may be noted that the difference in force on the door-sections varies with the degree of door-opening. When the doors are fully open, there is hardly any difference in air-pressure force. It is only when the doors are starting to close together that the pressure differential increases. Therefore, the designer preferably should ensure that the most favourable arcuate sectors occur as the doors are coming together.

Thus, the designer preferably should arrange that the angular rate of pivoting of the doors, per unit of travel of the actuator, should be smaller when the doors are together, and larger when the doors are fully open. Another benefit of this arrangement occurs when drivers operate the door remotely from their vehicle as they approach the door. Most drivers try to judge the opening swing of the door so they can pass through without stopping, and the driver would be more likely to make a misjudgment resulting in the vehicle hitting the door-section if the door-section that pivots towards the vehicle were to swing open quickly at first, and then slow down as the door-section opened wider.

The door-section 36A is made actually in two halves, 36AL and 36AR. Door-section 36B is in two halves 36BL and 36BR. In many mines, it simplifies the task of transporting the door-sections to the door site if the door-sections are in two halves, the halves being bolted together at the door site.

The door halves each comprise a frame of spars and a skin 44 attached thereto. It will be understood that the effect of the wind is different, whether the wind blows towards the plain-skin side of the half or towards the open-frame side. The open-frame side may be compared with a scoop, which collects the wind, whereby a larger force acts on the open-frame side than on the plain-skin side. This difference may be harnessed, and the difference utilised to bias the door to the closed position. Thus, the open-frame side should face upstream. Of course, when the door is fully closed there is no airflow, and no difference between the forces on the respective door-sections; but if the door should start to open, whereby air does start to flow, the force difference arising from the scoop effect will apply (slightly) more force to the upstream-facing door-section, whereby the door closes again. Thus, if the door should open slightly, a restoring force is created tending to close it again. Since the door is biassed to remain closed, no latch is needed to hold the door closed. This aspect can be important in the case where the ventilation doors are opened remotely from a vehicle, where it would be inconvenient if the driver also had to operate a latch.

As shown, only the outboard halves 36AR and 36BL of the doors present the open-frame or scoop side to the airflow, since not much difference in force is needed to keep the door closed. It will be understood that the scoop effect holds the door closed, whichever way the wind blows along the passage.

Figure 7:
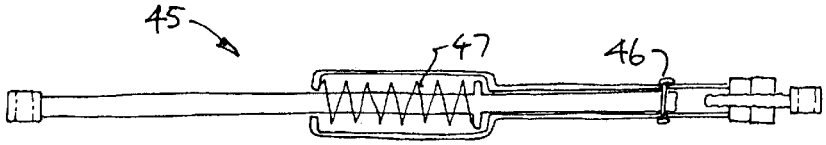
FIG. 7 is a view of a strut of the door apparatus of FIG. 6.

FIG. 7 shows another safety aspect that may be incorporated. The strut 45 fits in place of the connecting-link 37A of FIG. 6. Sometimes, when blasting is carried out in the mine, a pressure wave from the blast can travel along the tunnels and passages, and can blow the doors open—often with accompanying damage to the doors, hinges, actuators, etc, and perhaps injury to workers. In FIG. 7, a sheer pin 46 is arranged to break if the (momentary) force on the door should become too large. Once the sheer-pin has broken, the door can fly open without damaging the actuator. A spring 47 catches the swinging door, and absorbs the violence of the movement. In fact, depending on the forces involved, the designer might find it possible to dispense with the sheer pin, and, when the force on the actuator exceeds the setting of the spring, simply allow the door to open against the spring.

As depicted, the linkage for transmitting and balancing the forces between the two door-sections is mechanical, and includes simple fixed-length struts, as shown. An alternative is to actuate the doors by hydraulic ram, and to balance the forces hydraulically.

In alternative installations, the linkage may be more complex and sophisticated. Springs or weights may be used to further balance the door-sections, or to bias the door-sections to a closed or open or partially-open position.

Because the forces on the door-sections are balanced, sensors may readily be provided to measure any differences between the door-sections. It is usually a requirement that the position of ventilation doors be controlled from the surface, or at least that it be possible to tell from the surface whether the door is closed, open, or partially open. The fact that the door-sections are balanced simplifies this remote sensing and operation.

Preferably, the door-sections are identical, but they need not be. Preferably, each door-sect:ion is, at least for operational purposes, a single solid panel; however, the door-sections may include each more than one panel, which articulate for operation. This can be useful for example if space restricts the full swing of a single-panel door-section.

The linkage mechanism is depicted as fitting above the door; alternatively, the linkage may be placed in the floor underneath the door.

What is claimed is:

1. Apparatus comprising a door in association with a passage, wherein:

conditions in the passage are such that air flows along the passage from an upstream-side of the door to a downstream-side;

the passage has side-walls, being side-wall-A and side-wall-B;

the door is in two door-sections, being door-section-A and door-section-B;

door-section-A is hinged at hinge-A to side-wall-A, and door-section-B is hinged at hinge-B to side-wall-B;

the two door-sections are operably pivotable about the respective hinges between respective closed and open positions;

each door-section is so dimensioned as to extend only partway across the passage in the closed position of the door-sections;

in the closed position of the door-sections, the door-sections together close off the passage;

in the open position of the door-sections, the door-sections lie wide apart, creating a clear space between the door-sections;

the arrangement of the door-sections and the hinges is such that door-section-A opens in the direction towards the upstream-side of the door and door-section-B opens in the direction towards the downstream-side of the door;

the apparatus includes a linkage, which acts between the two door-sections, the structural arrangement of which is such that the linkage constrains the upstream opening and closing movements of door-section-A to correspond to the downstream opening and closing movements of door-section-B;

the linkage links the arcuate angular movement through which the door-sections pivot about the respective hinges, relative to each other;

the arrangement of the linkage is such that, in operation of the door-sections, the linkage constrains the angle through which door-section-A pivots about hinge-A to correspond proportionally to the angle through which door-section-B pivots about hinge-B.

2. Apparatus of claim 1, wherein, in a partially-open position of the door-sections, in which door-section-A lies upstream of its closed-position, and door-section-B lies downstream of its closed position, airflow along the passage creates a door-closing-force on door-section-A, and a door-opening-force on door-section-B.

3. Apparatus of claim 2, wherein the structural arrangement of the linkage is such that, during operation of the door-sections, the door-closing-force on door-section-A is transmitted, by the linkage, to door-section-B, and the door-opening-force on door-section-B is transmitted, by the linkage, to door-section-A.

4. Apparatus of claim 1, wherein the door is a ventilation door in an excavated underground tunnel.

5. Apparatus of claim 4, wherein:

the side-walls of the passage are vertical or approximately vertical, and the passage also includes a roof and a floor, and the fit of the door in relation to the side-walls, roof, and floor of the passage is such that, when closed, the closed door-sections prevent, or substantially restrict, air-flow along the passage; and the door-sections are capable of being opened sufficiently wide apart that, when open, free movement of vehicular traffic along the passage can take place between the open door-sections.

6. Apparatus of claim 1, wherein the apparatus includes a powered door-operator, for operating the door-sections between the open and closed positions.

7. Apparatus of claim 6, wherein the powered door-operator, when not powered, is able to be reversed, whereby the door-sections can be opened manually by a person pushing against one of the door-sections, without power being supplied to the door-operator.

8. Apparatus of claim 7, wherein the door-operator is an electrically-powered recirculating-ball screw-jack.

9. Apparatus of claim 6, wherein the powered door-operator includes a trip means, set at a door-closing force of no more than 100 lbs, whereby the door-operator cannot exert enough force to injure a person caught between the door-sections.

10. Apparatus of claim 1, wherein the arrangement of the linkage is such that, when the door-sections open, they move in arcuate unison, door-section-A upstream and door-section-B downstream.

11. Apparatus of claim 10, wherein the arrangement of the linkage is such that, during operation of the door-sections, the linkage constrains the arc through which door-section-A pivots about hinge-A to remain a fixed multiple of the arc through which door-section-B pivots about hinge-B.

12. Apparatus of claim 11, wherein the arrangement of the linkage is such that, during operation of the door-sections, the linkage constrains the arc through which door-section-A pivots about hinge-A to remain equal to the arc through which door-section-B pivots about hinge-B.

13. Apparatus of claim 1, wherein:

the linkage includes two lever-arms, being lever-arm-A mounted on door-section-A and lever-arm-B mounted on door-section-B;

each lever-arm is fixedly mounted on its respective door-section, whereby the lever-arm undergoes the same arcuate angular movement, during operation, as its respective door-section;

lever-arm-A carries an arm/link-attachment-point-A spaced from hinge-A, and lever-arm-B carries an arm/link-attachment-point-B spaced from hinge-B;

the linkage includes a connecting-linkage, which is attached between arm/link-attachment-point-A and arm/link-attachment-point-B.

14. Apparatus of claim 13, wherein:

the connecting-linkage comprises a simple, fixed-length, strut, which connects arm/link-attachment-point-A and arm/link-attachment-point-B;

arm/link-attachment-point-A and arm/link-attachment-point-B lie on the same side, being either the upstream-side or the downstream-side, of the door.

15. Apparatus of claim 13, wherein:

the connecting-linkage includes an actuation-bar, a bar-pivot-point of which is pivoted to the door-frame;

the actuation-bar carries bar/link-attachment-point-A and bar/link-attachment-point-B, which lie each on opposite sides of the bar-pivot-point;

the connecting-linkage includes two simple, fixed-length, struts, which connect respectively between arm/link-attachment-point-A and bar/link-attachment-point-A and between arm/link-attachment-point-B and bar/link-attachment-point-B;

arm/link-attachment-point-A and arm/link-attachment-point-B lie on opposite sides, one on the upstream-side and the other on the downstream-side, of the door.

16. Apparatus of claim 1, wherein the apparatus includes a powered door-operator, and the linkage includes a means for allowing the door-sections to swing open under a sudden heavy pressure-differential, and includes a force-limiting-means for limiting the force transmitted by the linkage to the door-operator, and includes a spring for absorbing the swinging motion.

17. Apparatus of claim 1, wherein each door-section has a respective area presented to, and exposed to, air pressure differential in the passage, and the respective areas are such that the force arising from the differential and acting to close door-section-A is substantially equal to the force arising from the differential and acting to open door-section-B.

18. Apparatus of claim 17, wherein the respective areas are equal.

* * * * *